United States Patent [19]

Scott

[11] Patent Number: 4,998,722

[45] Date of Patent: Mar. 12, 1991

[54] ISOTONIC EXERCISING APPARATUS

[76] Inventor: James W. Scott, P.O. Box 7630, Tifton, Ga. 31793

[21] Appl. No.: 450,450

[22] Filed: Dec. 14, 1990

[51] Int. Cl.[5] ..... A63B 23/04

[52] U.S. Cl. ..... 272/96; 272/136; 128/25 R; 128/25 B

[58] Field of Search ..... 272/126, 136–139, 272/142–143, 900, 93, 96, 70, 70 A, 117, 125; 128/80, 84 C, 25 B, 25 R, 882; 2/239, 240, 241

[56] References Cited

U.S. PATENT DOCUMENTS

| | | | |
|---|---|---|---|
| 399,699 | 3/1889 | Sachs | 272/137 |
| 2,644,448 | 7/1953 | Jardine | 128/84 R |
| 3,527,209 | 9/1970 | Baker | 128/80 E |
| 4,251,070 | 2/1981 | Leseburg | 272/143 |
| 4,325,548 | 4/1982 | Piccini | 272/136 |
| 4,371,161 | 2/1983 | Williams | 272/96 |
| 4,596,387 | 6/1986 | Roberts | 272/93 |
| 4,728,103 | 3/1988 | Fulton | 272/143 |
| 4,930,767 | 6/1990 | Hamm | 272/96 |

FOREIGN PATENT DOCUMENTS

| | | | |
|---|---|---|---|
| 332342 | 1/1921 | Fed. Rep. of Germany | 128/80 E |

*Primary Examiner*—Richard J. Apley
*Assistant Examiner*—Lynne A. Reichard
*Attorney, Agent, or Firm*—George A. Bode; Michael L. Hoelter

[57] ABSTRACT

An isotonic exercising apparatus for exercising the lower limb of a user. The apparatus provides a fabric sock slipped over the foot of the user. An elongated, elastic strip secures this sock to a support enabling the user to isotonically exercise his lower limb muscles by tensioning the strip.

8 Claims, 2 Drawing Sheets

ISOTONIC EXERCISING APPARATUS

BACKGROUND OF THE INVENTION

1. Field of the Invention

The present invention pertains to an exercising apparatus for a user's foot and, more particularly, to an isotonic exercising device worn by an otherwise immobile user.

2. General Background

Isometric and isotonic exercising is a well known method for bed-ridden or otherwise immobile patients to exercise. Because of such incapacitation, exercising of any type becomes very important.

In most cases, a patient is able to position themself to push against a fixed surface to exercise the intended muscle group. However, in other cases, the reason for being incapacitated is exactly the reason why the patient is unable to move or reposition him or herself as needed. In such cases, if the muscle group is to be exercised at all, the exercising apparatus must adapt to the patient. This is especially true for leg or lower torso injuries which severely diminish the patient's ability to move. In such cases, and especially if the leg or lower torso is in traction or otherwise held in place, the ability to exercise such muscle groups is often not available. Devices such as those shown in U.S. Pat. Nos. 4,805,605 to Glassman; 4,502,170 to Morrow; 3,857,390 to Harrison; 1,118,973 to Troesch; 4,185,813 to Spann; 3,717,144 to Bimler; and, 3,481,593 to Allen, et al. provide for various forms of immobilization of the leg, but no means for exercising the foot. German (BDR) Patent No. DE 31 13167 A1 provides a leg support (2) and foot piece (5) upon which a foot could be isometrically exercised.

It is thus an object of this invention to provide an exercising apparatus that is adaptable to a variety of users. Another object of this invention is to provide an apparatus that can exercise the lower muscle groups of a user even when the user's lower limbs are being supported or otherwise restrained in place. A further object of this invention is to provide an isotonic exercising apparatus that is fully adjustable so that it can be used regardless of the range of motion of the user. These and other features of this invention will become obvious upon further investigation.

The apparatus of the present invention is also used to help prevent clotting in the extremity or what is commonly referred to as thrombophlebitis or thrombosis. Ater a patient has an injury to an extremity or undergoes surgery, the blood flow in and out of the leg may be compromised. Slow flow often results in clotting in the veins of the leg which can become dislodged and travel through the vascular system to the lungs and can be life-threatening. It has been found that approximately thirty (30%) percent to forty (40%) percent of patients after hip or knee replacement develop some form of clotting. Not all of these patients will have the clot move and go to the lung, but it is a significant problem that requires treatment. Various apparatus and methods have been used in the past, particularly external devices to pump the calf to pump blood out of the leg. Other methods of treatment are to use anti-coagulation medications or drugs that will prevent the blood from clotting. By using this type of medication, however, it often makes the blood too thin and complications, such as bleeding from an ulcer or bleeding into the wound, can develop. This can result in life-threatening consequences; therefore, the medication can be very dangerous.

Therefore, in the past, doctors have used either medication to stop the blood from clotting or external devices to pump the blood back out of the leg. One object of this particular device is to use Mother Nature's own pump within the leg to get the blood back out of the leg and keep it circulating such that the clotting will not occur. It has been found best to elevate the leg which, by gravity, will remove some of the blood from the leg or to use the natural calf muscle as a pump. As one dorsiflexes and plantarflexes the foot, or pulls the toe up toward the knee and then pushes away, the calf musculature contracts and by so doing pumps the blood back out of the leg. There are valves in the leg that are designed to allow blood to flow up toward the knee and hip but not to let it flow back downward. By applying some resistance to which the patient can forcefully plantarflex or push the toes away from the knee, more compression of this natural muscle pump is allowed and in so doing allows more blood to be evacuated from the leg. The simple sock and elastic device of the present invention can be used on an elevation pillow. It can be used with casts or immobilizing devices for the knee or leg or even with some of the athletic braces commonly used. This is a much safer method of removing blood from the leg than external pneumatic compressing devices and is obviously much safer than using medications to "thin" the blood.

Therefore, the basic object of the apparatus of the present invention is to use the natural calf muscle and valve system to pump the blood out of the extremity and by so doing prevent stasis of the blood which allows thrombosis. There should be no significant chance for complications since it is a natural pump system and obviously should be much safer and more effective than the external device or anti-coagulation. One other object is obviously the economy of this apparatus when compared to the cost of medication or the external system.

SUMMARY OF THE PRESENT INVENTION

The preferred embodiment of the apparatus of the present invention solves the aforementioned problems in a straight forward and simple manner. What is provided is an exercising apparatus for exercising the lower extremity of a user wherein a fabric member is positioned around a foot of the user. Secured to this member or sock is a loop of elastic material. Generally this loop is secured to the sole of the toe-region of the sock and extends above it. One end of an elongated strip of similarly elastic material is affixed to this loop above the toe region. The other end of this elongated strip comprises attachment means for attachment to a support. Consequently, when properly fitted around the user's foot and securely attached, this exercising apparatus provides a surface against which the user can push.

BRIEF DESCRIPTION OF THE DRAWINGS

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 5:
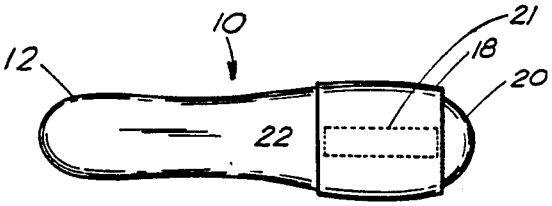
FIG. 5 is a bottom plan view of the embodiment of FIG. 1.
Figure 6:
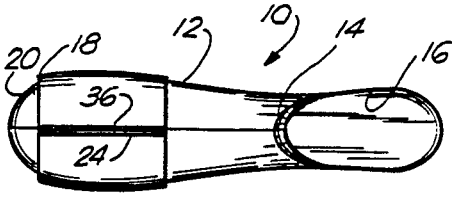
FIG. 6 is a top plan view of the embodiment of FIG. 1.
Figure 1:
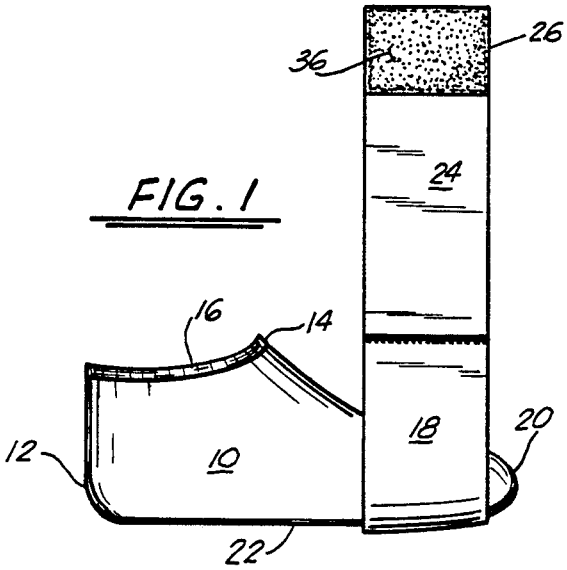
FIG. 1 is a right side elevational view of the preferred embodiment of the apparatus of the present invention.
Figure 2:
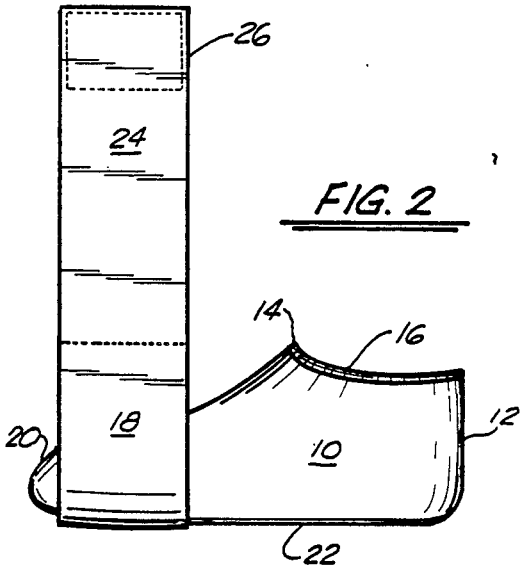
FIG. 2 is a left side elevational view of the embodiment of FIG. 1.
Figure 3:
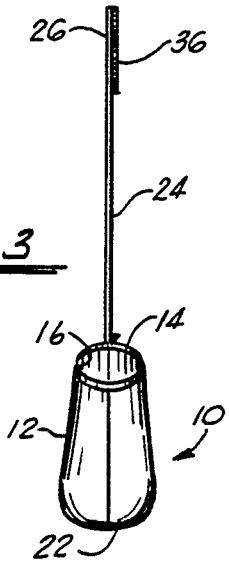
FIG. 3 is a rear elevational view of the embodiment of FIG. 1.
Figure 4:
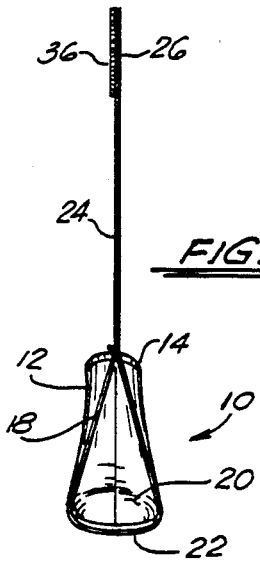
FIG. 4 is a front elevational view of the embodiment of FIG. 1.

Referring now to the drawings, and initially to FIGS. 1–6, there is shown isotonic calf exerciser 10. Exerciser 10 comprises a soft fabric sock 12 having elastic material 14 around its ankle opening 16. As can be expected, sock 12 can accommodate a wide variety of foot sizes and shapes, both for men and women. Preferably, sock 12 is made of a soft, breathable natural fabric such as cotton or a cotton blend, but it can also be made of a thin nylon or other synthetic material.

Loop 18 is secured at its base portion to toeregion 20 of sock 12. Normally loop 18 is stitched (by stitching 21 in phantom in FIG. 5) to sole 22 of sock 12, but it can also be secured around the edge of toe-region 20.

A portion of loop 18 extends above toe-region 20 (sock 12 being positioned within loop 18) and attaches to the proximate end of elongated strip 24. Generally, strip 24 and loop 18 are made of the same elastic material, such as nylon webbing, but they can also be made of different materials. Strip 24 extends well above sock 12 with its opposite or distal end, end 26, having a means 36 for attachment to a support 28. Means 36 is preferably VELCRO® fastening means.

Figure 7:
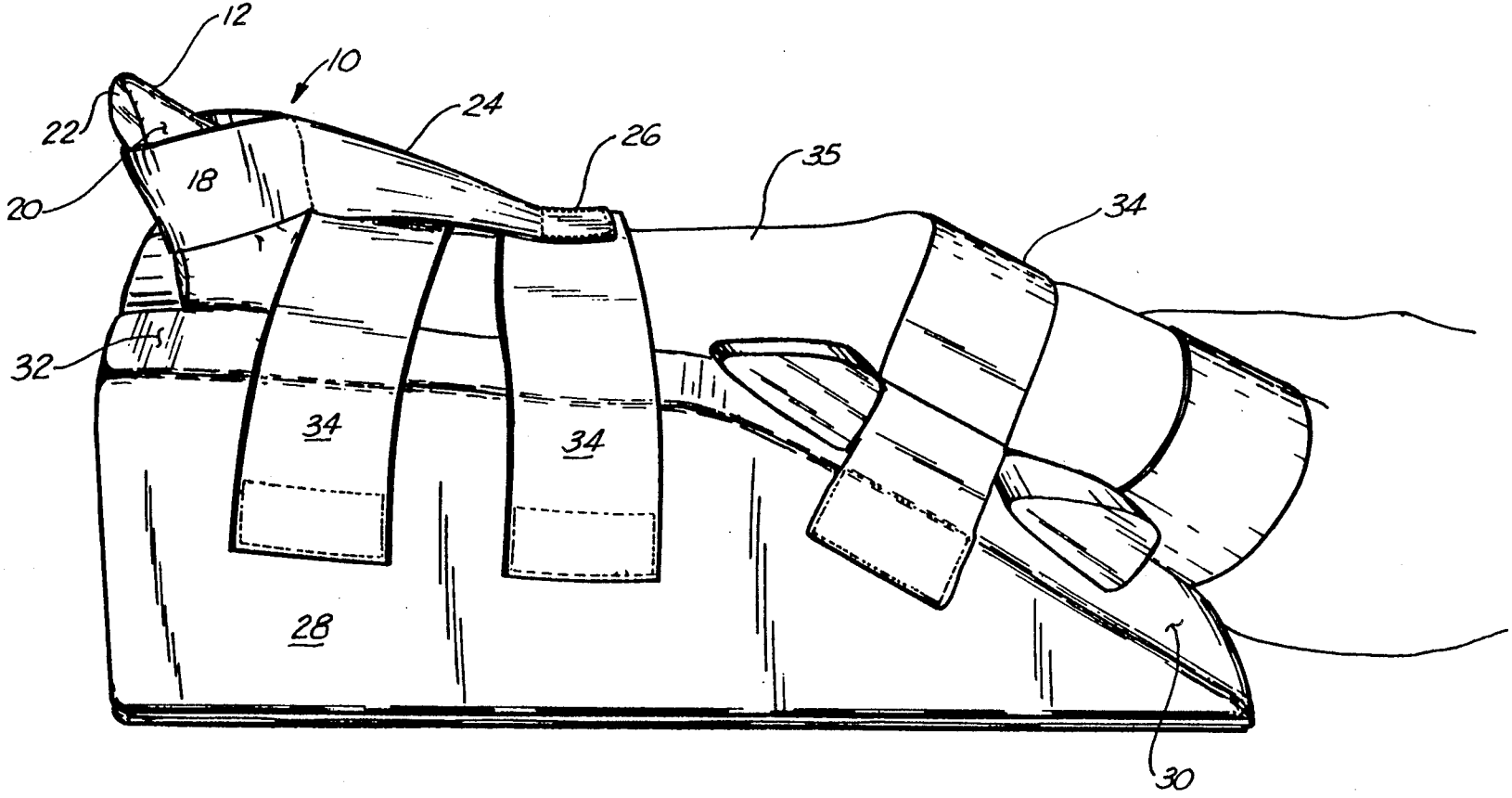
FIG. 7 is a perspective view of the apparatus of the present invention in conjunction with a support showing but one implementation by a user.

Referring now to FIG. 7, there is shown support 28 upon which a user rests his or her leg 35 (support 28 is my "Femoral Fracture Pillow," disclosed in my copending application and sold under the mark EZY WRAP® by Professional Products, Inc. of DeFuniak Springs, Fla.). As can be seen, the leg is elevated above the rest of the body with support 28 having an inclined section 30 and a horizontal section 32. A series of straps 34 restrain leg 35 upon support 28 and these straps 34 can be easily re-positioned along the length of the leg 35 as needed.

As illustrated in FIG. 7, exerciser 10 is fitted around the foot of the user with end 26 of strip 24 being secured to one of straps 34 by a hook and loop attachment means 36. Other attachment means or methods (buttons, snaps, stitching) are also equally applicable. Once end 26 is properly attached to strap 34, the user would flex his or her foot thereby tensioning and straining strip 24. The elastic strength of strip 24 enables only limited movement of sock 12 whilst the user is pushing against it - thus an isotonic exercising apparatus. The point of attachment of strip 24 on strap 34 is easily adjustable via attachment means 36, consequently sock 12 can be moved or adjusted as needed. Exerciser 10 is useful for exercising not only the calf and foot of the user, but also the muscles in the lower limb of the user.

Of course, exerciser 10 is usable without support 28, all that is needed for operation is a compatible mate to the attachment means 36 at end 26 of strip 24 so as to provide a surface against which the user may push.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as the invention is:

1. An exercising apparatus for the lower extremity comprising:

(a) an fabric member configured to fit around and enclose a user's foot;

(b) a loop of flexible material secured at its base portion around the toe-region of said fabric member, thereby positioning said fabric member within said loop, said loop extending above said toe-region to define an upper portion thereof;

(c) an elongated elastic member having its first, proximate end region secured to said loop at said upper portion thereof above said toe-region; and, (d) attachment means secured to the opposite, distal end region of said elongated elastic member for attachment to a support for the user's lower extremity.

2. The apparatus of claim 1, wherein said fabric member comprises a sock.

3. The apparatus of claim 2, wherein said sock comprises an elastic ankle member for closure around said user's ankle.

4. The apparatus of claim 3, wherein said loop is stitched to said sock.

5. The apparatus of claim 4, wherein said loop is stitched to the sole region of said sock.

6. The apparatus of claim 5, wherein said elongated elastic member comprises nylon webbing.

7. The apparatus of claim 6, wherein said attachment means comprises a hook and loop closure system.

8. An isotonic exercising system for the lower extremity comprising:

(a) a fabric member configured to fit around and enclose a user's foot;

(b) a loop of flexible material secured at its base portion around the toe-region of said fabric member, thereby positioning said fabric member within said loop, said loop extending above said toe-region to define an upper portion thereof;

(c) an elongated elastic member having its first proximate end region secured to said loop at the upper portion thereof above said toe-region; and, (d) attachment means secured to the distal end region of said elongated elastic member for attachment to a support member, said support member having means for elevating the lower extremity of the user and means for removably and selectively accepting said attachment means longitudinally of said base support member.

* * * * *